United States Patent [19]

Coutier

[11] Patent Number: 4,881,619

[45] Date of Patent: Nov. 21, 1989

[54] DEVICE FOR BARRING ACCESS TO THE TOP OF A VERTICAL TUBULAR DUCT

[75] Inventor: Charles Coutier, Thionville-Garches, France

[73] Assignee: Coutier Industrie, France

[21] Appl. No.: 261,873

[22] Filed: Oct. 25, 1988

[30] Foreign Application Priority Data

Oct. 30, 1987 [FR] France ..... 87 15115

[51] Int. Cl.[4] ..... E06C 9/10; E06C 5/36

[52] U.S. Cl. ..... 182/77; 182/106; 182/116

[58] Field of Search ..... 182/106, 77, 115, 116, 182/106, 128, 83

[56] References Cited

U.S. PATENT DOCUMENTS

| | | | |
|---|---|---|---|
| 257,867 | 5/1882 | Hendricks | 182/77 |
| 956,183 | 4/1910 | Scherrer | 182/94 |
| 2,535,544 | 12/1950 | McKinley | 182/77 |
| 3,038,555 | 6/1962 | Da Lee | 182/128 |
| 4,524,848 | 6/1985 | Russo | 182/77 |
| 4,664,225 | 5/1987 | Coutier | 182/106 |

FOREIGN PATENT DOCUMENTS

| | | | |
|---|---|---|---|
| 55011 | 4/1980 | Denmark . | |
| 2095 | 1/1977 | Japan | 182/77 |

*Primary Examiner*—Reinaldo P. Machado

*Attorney, Agent, or Firm*—Griffin, Branigan & Butler

[57] ABSTRACT

Access to the top of a caged ladder (2, 3) is barred by the device of the invention which comprises a door panel (6) and a closure member (10) both hinged about respective vertical axes (**7*b*, 12), and interconnected like a pair of compasses by a hinge piece (11) and a lever (14) which engages in a slot (13**) of the hinge piece.

9 Claims, 3 Drawing Sheets

DEVICE FOR BARRING ACCESS TO THE TOP OF A VERTICAL TUBULAR DUCT

BACKGROUND OF THE INVENTION

It may be necessary to restrict access to the top of a tubular duct (such as a ladder cage or an inspection duct leading to an underground installation) to authorized persons only because the duct may lead to a security zone or to dangerous materials. Access must therefore be barred by a device which can be operated only by persons possessing the means for unlocking it. However, such barring should not hinder the passage of any user coming up the duct as an emergency exit.

Devices exist for performing this function which comprise a trapdoor-type of flap hinged about a horizontal axis. The main drawback of such devices lies in the fact that the hinged flap may pivot under its own weight from its closed position to its open position if it opens downwardly or from its open position to its closed position if it opens upwardly. This may give rise to accidents due to a slip while opening the flap or due to the flap being improperly latched when in its open position, with the moving panel then striking the person occupying the volume through which it moves (on the head or the hands).

In addition, when a ladder exceeds a certain height, it is necessary to provide landing places, i.e. platforms where the user can stand and let go the ladder in order to take a rest. Conventionally, such rest landing places are constituted by horizontal gangways which serve to interconnect two successive lengths of ladder which are horizontally offset from each other, such that the user is constrained to make use of the gangway both when going up and when going down the ladder. This type of construction is more expensive than a straight ladder and requires additional volume for its installation because of the offset between the lengths of ladder.

The present invention proposes a device for closing a tubular duct which is designed to bar access thereto in a way which avoids the drawbacks of a hinged flap and which also serves to constitute a rest landing place which avoids the need for constructing ladders in offset lengths.

SUMMARY OF THE INVENTION

To this end, the invention thus provides a device for closing a tubular duct fitted with ladder rungs, with the main component of the device being a closure member or flap which is retractable by pivoting about a vertical hinge axis which is fixed and located to one side of the rungs.

When said closure member is used as a device for barring access to the top of the duct, the area of the closure member is substantially equal to the right cross-section of the duct, and the closure member is pivoted about the vertical axis by means of a lockable hinge, which can be unlocked by a person above the closure member only by means of an appropriate tool, whereas it can be opened manually without the need for any accessory by a user who is beneath the closure member.

The means for actuating and locking said hinge comprise an operating lever pivotally mounted about a second fixed vertical axis which is rotatably coupled with the closure member.

In a first embodiment, the lever rotates with a first toothed wheel meshing with a second tooth wheel that is keyed to the closure member.

In a second preferred embodiment, the closure member is hinged about its vertical pivot axis by means of a hinged piece which is fixed thereto and which includes an oblong radial opening which receives a drive finger of an operating lever which is itself hinged about a second vertical axis situated perpendicularly relative to the longitudinal direction of the slot and passing through said finger when said finger is placed at the outermost end of said slot, with the closure member being in its access-barring position.

In both embodiments, when the top access to the tubular duct (which may be a caged ladder, for example), is level with the edge of a terrace, the above-mentioned lever is constituted by a hinge piece for a vertical panel or door which is hinged about the second fixed axis.

In this application, the plane in which the closure member moves intersects the door panel, with the portion of said panel situated beneath the plane in which the closure member moves including a handle on its face turned towards the inside of the tubular duct for unlocking a lock carried by the panel, which lock is accessible by means of a key from the face of the panel turned away from the tubular duct.

BRIEF DESCRIPTION OF THE DRAWINGS

Embodiments of the invention are described by way of example with reference to the accompanying drawings, in which.

MORE DETAILED DESCRIPTION

Figure 1:
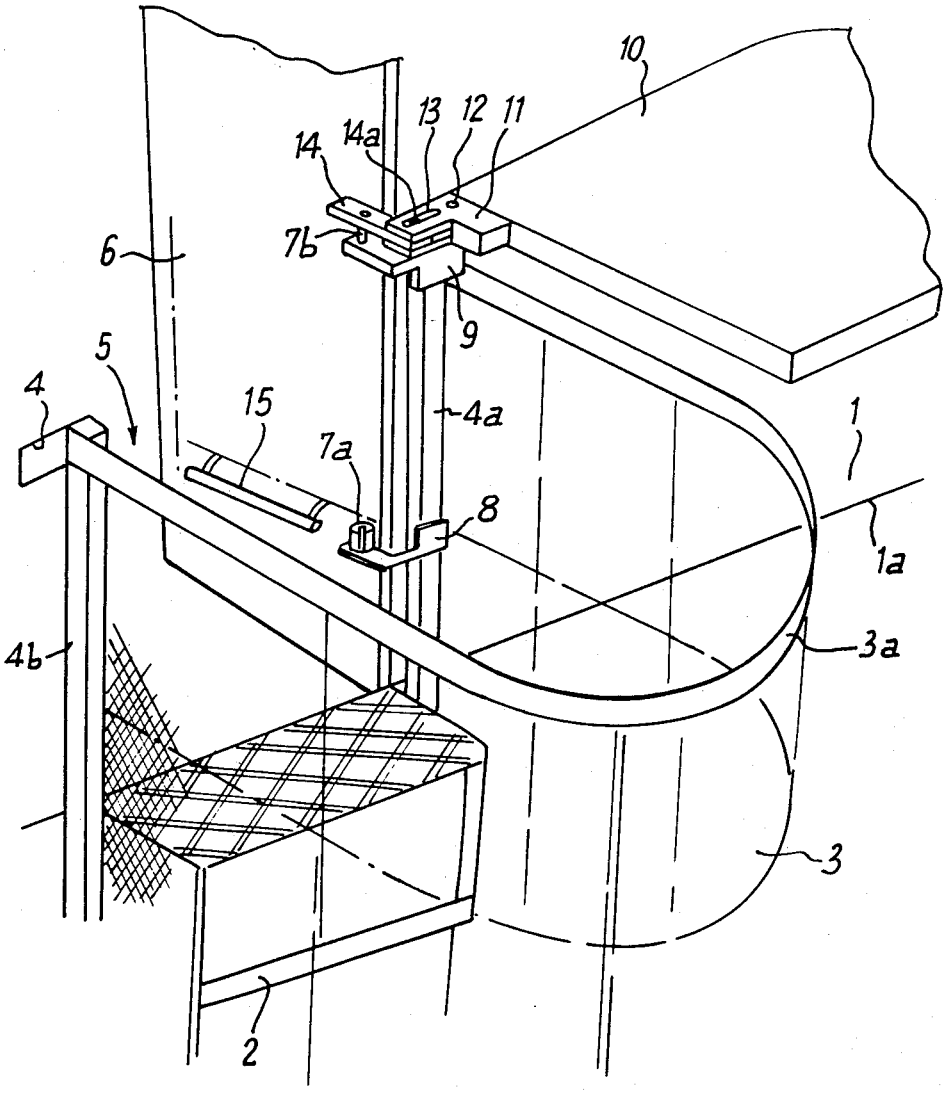
FIG. 1 is a diagram of a device in accordance with the invention used for barring access to the top of a caged ladder situated at the edge of a terrace.

With reference initially to FIG. 1, a terrace 1 has an edge 1a from which there runs a ladder 2 in a cage 3. A guard-rail 4 runs along the edge of the terrace and defines a passage 5 giving access to the ladder from the terrace. The top portion 3*a* of the cage forms a guard-rail and is therefore raised above the level of the terrace, for example it may be level with the guard-rail 4.

The access passage 5 is barred by a door 6 hinged about a vertical axis constituted by two fixed pivots 7*a* and 7*b*. The bottom pivot 7*a* is carried by a fixed piece 8 which is of conventional design and fixed to a stanchion 4*a* of the guard-rail 4 and connected to the top portion of the cage.

The other pivot 7*b* is also carried by a fixed piece 9 which constitutes a support for the hinge mechanism of a closure member 10 (shown in its open position) which, together with the door, bars access to the tubular duct formed by the cage 3 by taking up a position over the cage. The area of the closure member 10 is substantially equal to the cross-section of the cage.

The hinge mechanism of the closure member 10 includes a piece 11 fixed to the closure member 10 and hinged about a pivot 12 which is carried by the fixed piece 9. The piece 11 has a radial opening 13 which receives a finger 14a fixed to a lever 14 which is both hinged to the pivot 7b and fixed to the door panel 6. The operation of this hinge mechanism is described below in detail with reference to FIG. 2.

In FIG. 1, it may be observed that the plane in which the closure member 10 moves is situated in the vicinity of the middle portion of the door panel 6. Beneath this plane, the panel 6 includes a handle 15 which, in conventional manner for emergency exits, acts on a lock mechanism of the panel 6 for locking the panel to one of the stanchions 4b of the guard-rail 4. The lock is not shown, but dot-dashed lines represent the operating connection between the handle 15 and the lock. The normal access to the lock is on the face of the panel 6 facing the terrace 1. The cage 3 has grid or mesh to prevent access to the handle 15 from the terrace 1.

Figure 2:
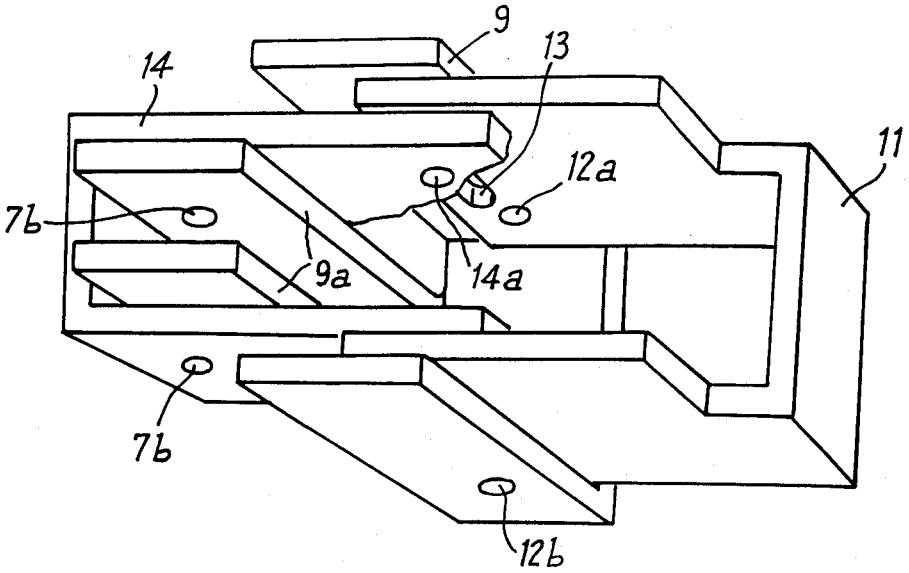
FIG. 2 is a view of one particular embodiment of the hinge used in the invention.

FIG. 2 shows the combined closure member and door hinge mechanism, with the door and the closure member omitted.

The figure shows the fixed piece 9 which supports the pivot 12 which in this case is in two parts 12a and 12b, and which also has lateral extensions 9a for supporting the pivot 7b which is likewise in two parts. The piece 11 which is U-shaped thus has an oblong opening 13 which extends substantially radially relative to the pivot 12 and in which a drive finger 14a of the lever 14 is received, which lever is hinged to the piece 9 about the pivot 7b. It will be understood that by pivoting the lever 14 about the axis 7b, a corresponding pivot action is obtained for the piece 11 about the axis 12. This pivoting drive is reversible except in one or two positions and providing that certain conditions are satisfied.

Figure 3:
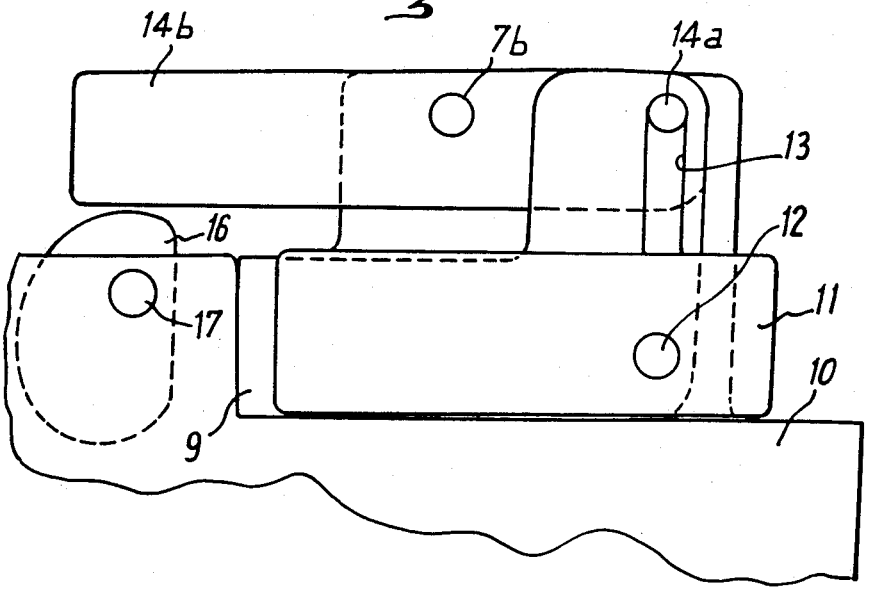
FIG. 3 is a diagrammatic plan view of a hinge of the closure member fitted with an unlocking member.

These positions are the positions shown in FIGS. 2 and 3, i.e. the positions in which the closure member is fully open or fully closed.

In its closed position (FIG. 3) the longitudinal axis of the oblong opening 13 must be perpendicular to the line connecting the centers of the pivot 7b and the finger 14a of the lever 14, with the finger 14a being situated at the outermost end of the opening 13. It can be seen that this condition prevents the closure member from moving anticlockwise about the pivot 12, with the lever 14 constituting a buttress preventing such motion.

In the fully opened position (FIG. 2) the same buttress effect is reproduced since each of the parts 12 and 14 has rotated through 90°.

Thus, by providing a device for returning the closure member to its closure position, access is automatically closed and locked when it is in its closure position. This return device may be coupled between a fixed part and the closure member, or between the lever 14 and the closure member, or else between the lever 14 and a fixed part, and each of which configurations is conventional. The return member may be a spring hinge disposed in one or other of the pivots 7b and 12. All that then needs to be done is to prevent access to the lever 14 from above, by placing the lever beneath the closure member 14 or beneath a protective wall carried by said closure member, e.g. when the lever 14 is not fixed to a door but constitutes a mere door knob or handle for opening the closure member when going upwards.

A return device may also be provided to return the closure member towards its fully opened position in which it is also locked. If it is necessary to prevent such locking on opening, abutments can be provided to limit the extent to which the parts 12 and 14 are allowed to rotate about their axes.

It may also be observed, returning to FIG. 2, that the parts which are hinged to one another are advantageously U-shaped, thereby making it possible to obtain a device which is very strong and very compact. Naturally, the arrangements visible in FIG. 2 also exist on the bottom arms of the U-shaped parts which are shown from below.

It is also mentioned that the slot 13 is not strictly radial relative to the axis 12. It merely needs to satisfy the conditions specified above. Its location in the piece 11 and the lengths of the lever arms used in the mechanism depend on the forces that need to be developed in order to unlock the closure member.

Returning finally to FIG. 3, it may be observed that the lever 14 has an extension 14b extending beyond the axis 7b relative to the finger 14a, and this extension may constitute the operating handle and it may also co-operate with a camming surface 16 which is hinged at 17 to the closure member 10 (or to any support coupled thereto). The cam 16 may be rotated about the axis 17 from above the closure member 10 by means of any appropriate tool, and in particular by means of a key. It can be seen that when rotated clockwise, the cam 16 rotates the lever 14 and interrupts the buttress effect between the slot 13 and the finger 14a. Thereafter, it is possible to move the closure member directly by pivoting about the axis 12 using a handle provided thereon for this purpose.

Figure 4:
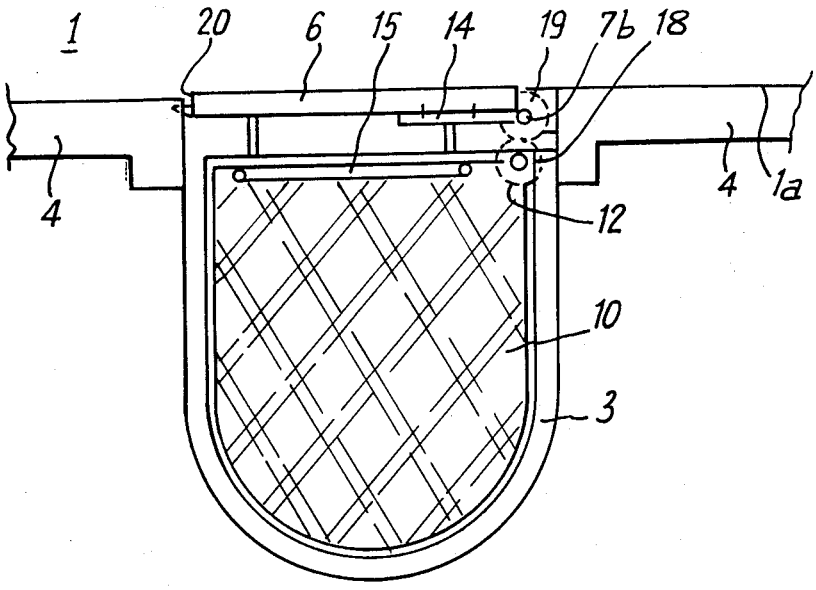
FIG. 4 is a diagram of another embodiment of the device of the invention applied to barring top access.

FIG. 4 is a plan view of a second embodiment of the invention applied to barring top access from a terrace 1 to a ladder cage 2, 3, with the closure member 10 being fixed at the axis 12 to a toothed wheel 18 which meshes with a toothed wheel 19 which is fixed to the lever 14 which is fixed in turn to the door panel 6 which is hinged about the axis 7b. As in FIG. 1, the handle 15 serves to operate the lock 20 of the door 6 enabling the door to be opened.

Figure 5:
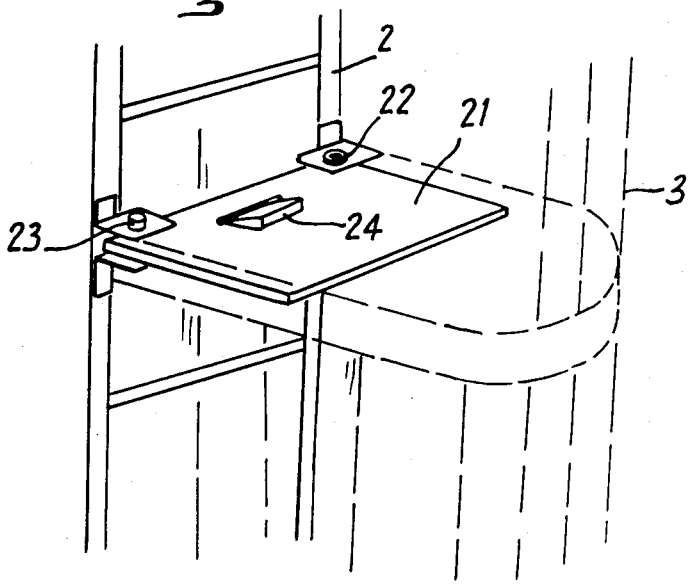
FIG. 5 shows the invention applied to constituting a rest landing.

Finally, in FIG. 5, the device of the invention is constituted merely by a flap 21 which constitutes a retractable rest landing whieh is hinged at 22 in the vicinity of one of the lateral risers of the ladder 2 and which is locked to the other riser by means of a finger 23. The finger may be retracted downwardly by acting on a pedal 24 if a user wants to go down or by acting on a pull handle (not shown) situated beneath the flap 21 by a user wanting to go up.

The hinge 22 may include a device which returns to the panel 21 either out from the cage 3 or else into the cage 3, depending on requirements.

The invention is advantageously applicable to safety ladders.

I claim:

1. A device for closing a substantially vertical tubular duct provided with ladder rungs, wherein the device includes a closure member which is retractable by pivoting about a fixed vertical hinge axis provided to one side of the rungs, and means for rotating and for locking the closure member, said means comprising an operating lever pivotally mounted about a second fixed vertical axis adjacent to the above-mentioned axis, and coupled to rotate with the closure member.

2. A device according to claim 1, wherein the lever is fixed to a toothed wheel meshing with a toothed wheel keyed to the closure member.

3. A device according to claim 1, used as a device for barring access to the top of the tubular duct, wherein the area of said closure member is substantially equal to the right cross-section of the duct, and wherein said closure member is hinged about a vertical axis by means of a hinge piece fixed thereto, said hinge member including an oblong opening receiving a drive finger of an operating lever which is hinged about a second fixed vertical axis situated perpendicularly relative to the longitudinal direction of the slot and passing through the above-mentioned finger when said finger is at the outermost end of said slot, with the closure member being in its access-barring position.

4. A device according to claim 3, wherein the above-mentioned lever is constituted by a hinge piece for a vertical door hinged about the second fixed axis.

5. A device according to claim 3, wherein the above-mentioned lever is situated beneath the closure member.

6. A device according to claim 5, wherein the closure member has a camming surface which is retractable by means of an actuating lock and co-operating with a portion of the lever situated beyond its hinge axis relative to the drive finger.

7. A device according to claim 1, wherein the closure member includes a return member for returning it to its closed position.

8. A device according to claim 1, wherein the lever includes a return member for returning it to its position in which it locks the closure member.

9. A device according to claim 4, wherein the plane in which the closure member moves intersects the door panel, with the portion of the panel situated beneath said plane including a handle on its face facing towards the inside of the tubular duct, said handle serving to unlock a lock carried by the panel and accessible from the face of the panel facing away from the tubular duct by means of a key.

* * * * *